US009917363B1

(12) United States Patent
Gauba et al.

(10) Patent No.: US 9,917,363 B1
(45) Date of Patent: Mar. 13, 2018

(54) ADJUSTABLE CROSS-POLARIZED ANTENNA ARRAY ELEMENTS

(71) Applicant: SPRINT COMMUNICATIONS COMPANY, L.P., Overland Park, KS (US)

(72) Inventors: Maneesh Gauba, Overland Park, KS (US); Stephen R. Bales, Lee's Summit, MO (US); Greg T. Nohalty, Overland Park, KS (US); Matthew J Masters, Greenfield, IN (US)

(73) Assignee: Sprint Communications Company L.P., Overland Park, KS (US)

( * ) Notice: Subject to any disclaimer, the term of this patent is extended or adjusted under 35 U.S.C. 154(b) by 643 days.

(21) Appl. No.: 14/542,132

(22) Filed: Nov. 14, 2014

(51) Int. Cl.

| | |
|---|---|
| ***H01Q 3/24*** | (2006.01) |
| ***H01Q 1/24*** | (2006.01) |
| ***H01Q 21/06*** | (2006.01) |
| ***H01Q 25/00*** | (2006.01) |
| *H01Q 3/34* | (2006.01) |

(52) U.S. Cl.
CPC ..... *H01Q 3/24* (2013.01); *H01Q 1/246* (2013.01); *H01Q 21/062* (2013.01); *H01Q 25/001* (2013.01); *H01Q 3/34* (2013.01)

(58) Field of Classification Search
CPC ..... H01Q 3/24; H01Q 25/001; H01Q 21/062; H01Q 1/246
See application file for complete search history.

(56) References Cited

U.S. PATENT DOCUMENTS

| | | | | |
|---|---|---|---|---|
| 4,728,897 | A * | 3/1988 | Gunton | G01S 7/026 324/329 |
| 5,434,575 | A * | 7/1995 | Jelinek | H01Q 21/062 342/365 |
| 6,747,606 | B2 | 6/2004 | Harel et al. | |
| 7,113,748 | B2 * | 9/2006 | Shapira | H01Q 1/246 342/361 |
| 7,348,924 | B2 * | 3/2008 | Guillouard | H04B 7/0491 342/432 |
| 8,618,998 | B2 | 12/2013 | Kikin | |
| 8,779,976 | B2 | 7/2014 | Eom et al. | |
| 9,369,881 | B1 * | 6/2016 | Chukka | H04W 16/28 |
| 2008/0158054 | A1 * | 7/2008 | Yong | H01Q 3/24 342/374 |

* cited by examiner

*Primary Examiner* — Gregory C. Issing

(57) ABSTRACT

A method, system, and medium are provided for dynamically adjusting an angular orientation of cross-polarized antenna array elements to optimize select radio-frequency (RF) parameters. RF uplink signals are received from a plurality of mobile devices, and the signals are analyzed to determine parameters associated with signal strength and/or signal quality. Based on the determination, a first set of cross-polarized antenna array elements are deactivated and a second set of cross-polarized antenna array elements are activated, where the second set of antenna array elements has a different angular orientation relative to the first set of antenna array elements. Activation enables the second set of antenna array elements to transmit and receive communication signals.

18 Claims, 5 Drawing Sheets

ADJUSTABLE CROSS-POLARIZED ANTENNA ARRAY ELEMENTS

SUMMARY

A high level overview of various aspects of the invention is provided here for that reason, to provide an overview of the disclosure and to introduce a selection of concepts that are further described in the detailed-description section below. This summary is not intended to identify key features or essential features of the claimed subject matter, nor is it intended to be used as an aid in isolation to determine the scope of the claimed subject matter.

In brief, and at a high level, this disclosure describes, among other things, computer-readable media, methods, and systems for dynamically adjusting the angular orientation of cross-polarized antenna array elements associated with a base station in order to optimize select radio-frequency (RF) signal parameters for mobile devices served by the base station. In aspects, the base station transmits a RF signal to mobile devices using a first set of cross-polarized antenna array elements having a first angular orientation. RF uplink signals from the mobile devices are then received by the base station and analyzed to determine certain RF signal parameters such as, for example, signal strength indicators and/or signal quality indicators. These parameters provide information on the quality and/or strength of the RF downlink signal transmitted by the first set of cross-polarized antenna array elements. Based on these parameters, the base station may deactivate the first set of antenna array elements and activate a second set of cross-polarized antenna array elements, where the second set is at a different angular orientation as compared to the first set. The second set of cross-polarized antenna array elements is then used to transmit and receive communication signals. The angular orientation of the cross-polarized antenna array elements continues to be adjusted using the process described above in order to optimize the strength and/or the quality of the RF downlink signal. The result is an improved user experience in the form of faster download times, fewer dropped calls, and clearer voice reception.

BRIEF DESCRIPTION OF THE FIGURES

Illustrative embodiments of the present invention are described in detail below with reference to the attached drawing figures, and wherein.

DETAILED DESCRIPTION

Figure 1:
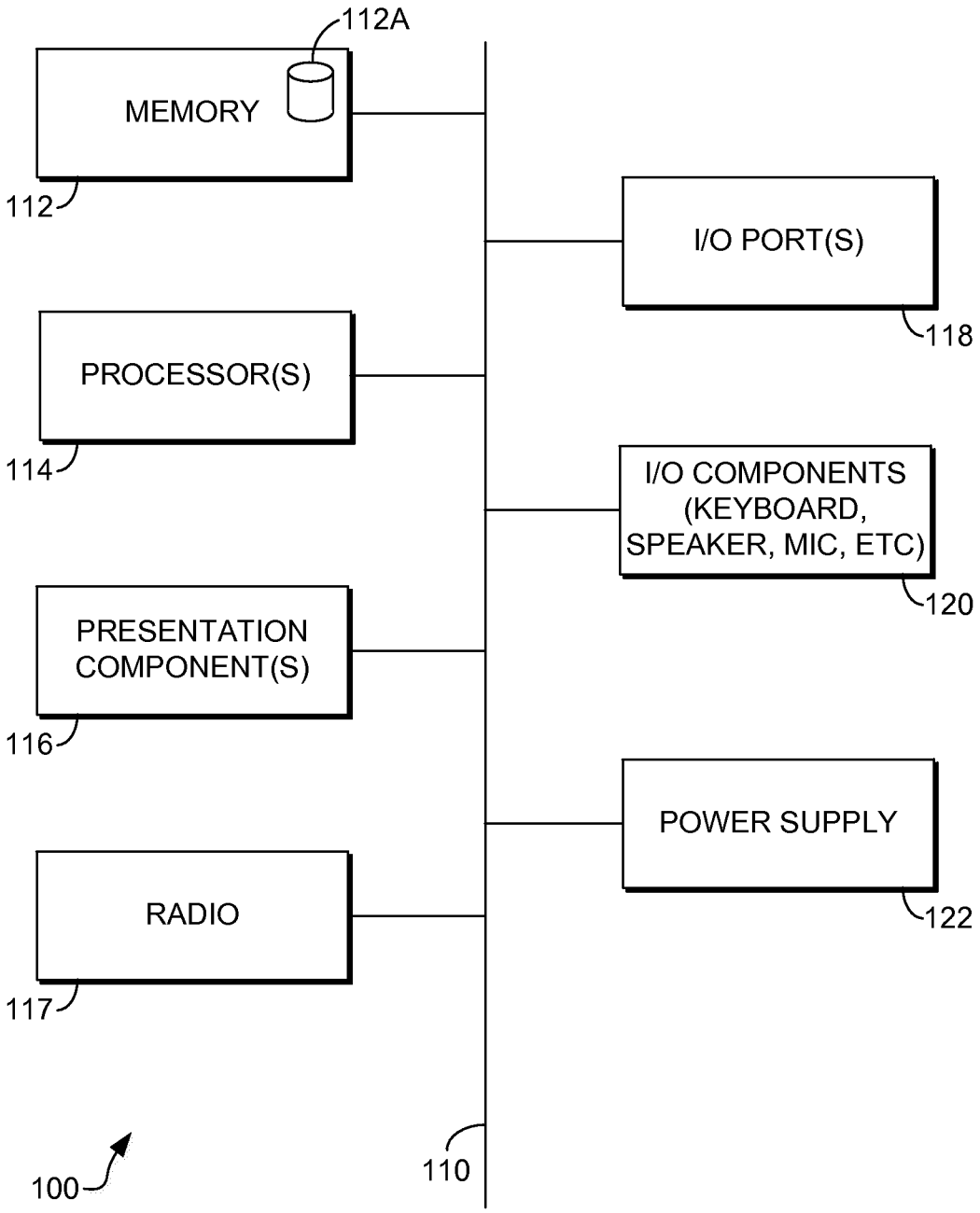
FIG. 1 depicts an exemplary mobile device according to an embodiment of the technology.

The subject matter of select embodiments of the present invention is described with specificity herein to meet statutory requirements. But the description itself is not intended to define what we regard as our invention, which is what the claims do. The claimed subject matter might be embodied in other ways to include different steps or combinations of steps similar to the ones described in this document, in conjunction with other present or future technologies. Terms should not be interpreted as implying any particular order among or between various steps herein disclosed unless and except when the order of individual steps is explicitly described.

The present invention may be embodied as, among other things, a method, system, or a set of instructions embodied on one or more computer-readable media. Aspects hereof relate to dynamically adjusting the angular orientation of cross-polarized antenna array elements of a base station to optimize select RF signal parameters associated with mobile devices served by the base station. Traditionally, the angular orientation of cross-polarized antenna array elements has been fixed at around +45 degrees for one antenna element and +135 degrees (or −45 degrees) for the cross-polarized element. This particular angular orientation, moreover, was generally based on the assumption that most mobile device antennas would be held at a +45 degree angle when in use—the angle of the antenna when a mobile device is held to the ear of a subscriber during a voice call. By having the radiating elements (the antenna elements and the mobile device antenna) in the same plane, optimal transfer of signal energy occurs. However, as mobile devices become more frequently used for data (gaming, watching audio-visual content, viewing social media content or news content, etc.), the mobile device antenna may now be oriented vertically (i.e., at 0 degrees) or horizontally (i.e., at +90 degrees). The result is that the typical +45/135 degree angular orientation of the cross-polarized antenna array elements may not provide optimal RF signal strength and/or quality to the mobile devices.

Aspects hereof relate to monitoring RF signals received from mobile stations and analyzing the signals to determine, for instance, signal strength indicators and signal quality indicators associated with the received RF signals. Based on these parameters, the base station may select a new set of antenna array elements by which to transmit and receive RF signals, where the new set of antenna array elements has a different angular orientation as compared to the set of antenna array elements that was previously used to transmit and receive the RF signals. Activation of the new set may occur when the RF signal parameters indicate that the RF downlink signal transmitted by the base station is of less than optimal strength and/or quality based on the distance of the mobile devices from the base station. This may occur when the mobile device antennas are oriented at an angle different from that of the antenna array elements. For example, this may happen when the majority of the mobile devices are currently being used for data as compared to voice, or vice versa. The angular orientation of the cross-polarized antenna array elements is adjusted in an effort to more closely match the angle at which the majority of mobile device antennas are being used, thereby resulting in improved RF signal parameters. In other words, because the angular orientations of the radiating elements more closely approximate each other, there is improved signal strength and/or quality at the mobile devices.

Accordingly, in one aspect, the present invention is directed to one or more non-transitory computer-readable media having computer-executable instructions embodied thereon that, when executed, perform a method of dynamically adjusting an angular orientation of antenna array elements of a base station to optimize select RF signal parameters associated with a plurality of mobile devices. The method comprises receiving at the base station a first set of RF signals from the plurality of mobile devices and processing the first set of RF signals to determine one or more parameters associated with the first set of RF signals. Based on the one or more parameters, the base station deactivates a first set of cross-polarized antenna array elements and activates a second set of cross-polarized antenna array elements, where the second set of antenna array elements has a different angular orientation as compared to the first set of antenna array elements.

In another aspect, a computerized method carried out by at least one server having at least one processor is provided for performing a method of dynamically adjusting an angular orientation of cross-polarized antenna array element to optimize select RF signal parameters. The method comprises receiving at the base station a plurality of RF signals from a plurality of mobile devices and analyzing, using the one or more processors, the plurality of RF signals to determine one or more parameters associated with the received signals, the one or more parameters comprising at least one of signal strength indicators or signal quality indicators. Based on the one or more parameters, a set of cross-polarized antenna array elements is activated to transmit a RF signal to the plurality of mobile devices, where the set of antenna array elements has a different angular orientation from a previous set of cross-polarized antenna array elements that was previously activated.

In yet another aspect, a system is provided for dynamically adjusting an angular orientation of cross-polarized antenna array elements to optimize select RF signal parameters. The system comprises a computing device having one or more processors and one or more computer-readable media having computer-executable instructions embodied thereon that, when executed by the one or more processors, perform operations that comprise activating a first set of cross-polarized antenna array elements associated with a base station, where the first set of antenna array elements has a first angular orientation. The computing device further receives RF signals from a plurality of mobile devices and analyzes the RF signals received from at least a portion of the plurality of mobile devices to determine one or more RF signal parameters associated with the received signals. Based on the one or more RF signal parameters, the computing device activates a second set of cross-polarized antenna array elements associated with the base station, where the second set of antenna array elements has a second angular orientation different from the first angular orientation.

Throughout this disclosure, several acronyms and shorthand notations may be used to aid the understanding of certain concepts pertaining to the associated system and services. These acronyms and shorthand notations are intended to help provide an easy methodology of communicating the ideas expressed herein and are not meant to limit the scope of the present invention. Further, various technical terms are used throughout this description. An illustrative resource that fleshes out various aspects of these terms can be found in Newton's Telecom Dictionary, 27$^{th}$ Edition (2012). The following is a list of acronyms:

BS Base Station
CDMA Code Division Multiple Access
DL Downlink
eNodeB Evolved Node B
GIS Geographic Information System
2GPP 2$^{nd}$ Generation Partnership Project
3GPP 3$^{rd}$ Generation Partnership Project
GPRS General Packet Radio Service
GSM Global System for Mobile Communications
LTE Long-Term Evolution
MD Mobile Device
RCPI Received Channel Power Indicator
RF Radio-Frequency
RRH Remote Radio Head
RRU Remote Radio Unit
RSRP Reference Signal Receive Power
RSRQ Reference Signal Receive Quality
RSSI Received Signal Strength Indicator
SINR Signal-to-Interference-Plus-Noise Ratio
SNR Signal-to-Noise Ratio
UL Uplink
WCDMA Wideband Code Division Multiple Access Further, various technical terms are used throughout this description. An illustrative resource that fleshes out various aspects of these terms can be found in Newton's Telecom Dictionary, 25th Edition (2009).

Embodiments of the present invention may be embodied as, among other things, a method, system, or set of instructions embodied on one or more non-transitory computer-readable or computer-storage media. Computer-readable media comprises physical storage devices and include both volatile and nonvolatile media, removable and nonremovable media, and contemplates media readable by a database, a switch, and various other network devices. By way of example, and not limitation, computer-readable media comprise media implemented in any method or technology for storing information. Examples of stored information include computer-useable instructions, data structures, program modules, and other data representations. Media examples include, but are not limited to computer-storage media such as information-delivery media, RAM, ROM, EEPROM, flash memory or other memory technology, CD-ROM, digital versatile discs (DVD), holographic media or other optical disc storage, magnetic cassettes, magnetic tape, magnetic disk storage, and other magnetic storage devices. These technologies can store data momentarily, temporarily, or permanently.

Referring to the drawings in general, and initially to FIG. 1 in particular, a block diagram of an illustrative mobile device according to one embodiment is provided and referenced generally by the numeral 100. Although some components are shown in the singular, they may be plural. For example, the mobile device 100 might include multiple processors or multiple radios, etc. As illustratively shown, the mobile device 100 includes a bus 110 that directly or indirectly couples various components together including memory 112, a processor 114, a presentation component 116, a radio 117 (if applicable), input/output ports 118, input/output components 120, and a power supply 122.

Memory 112 might take the form of memory components previously described. Thus, further elaboration will not be provided here, only to say that the memory component 112 can include any type of medium that is capable of storing information (e.g., a database). A database can be any collection of records. In one embodiment, memory 112 includes a set of embodied computer-executable instructions 112A that, when executed, facilitate various aspects disclosed herein. These embodied instructions will variously be referred to as "instructions" or an "application" for short.

The processor 114 might actually be multiple processors that receive instructions and process them accordingly. The presentation component 116 includes the likes of a display, a speaker, as well as other components that can present information (such as a lamp (LED), or even lighted keyboards).

Numeral 117 represents a radio(s) or antenna that facilitates communication with a wireless-telecommunications-network including, for example, a base station or eNodeB associated with the wireless-telecommunications-network. Illustrative wireless-telecommunications technologies include CDMA, GPRS, TDMA, GSM, and the like. The radio/antenna 117 might additionally or alternatively facilitate other types of wireless communications including Wi-Fi, WiMAX, LTE, or other VoIP communications. As can be appreciated, in various embodiments, the radio/antenna 117 can be configured to support multiple technologies and/or multiple radios/antennas can be utilized to support multiple technologies.

The input/output port 118 might take on a variety of forms. Illustrative input/output ports include a USB jack, stereo jack, infrared port, proprietary communications ports, and the like. The input/output components 120 include items such as keyboards, microphones, speakers, touch screens, and any other item usable to directly or indirectly input data into the user device 100. The power supply 122 includes items such as batteries, fuel cells, or any other component that can act as a power source to power the user device 100.

Figure 2:
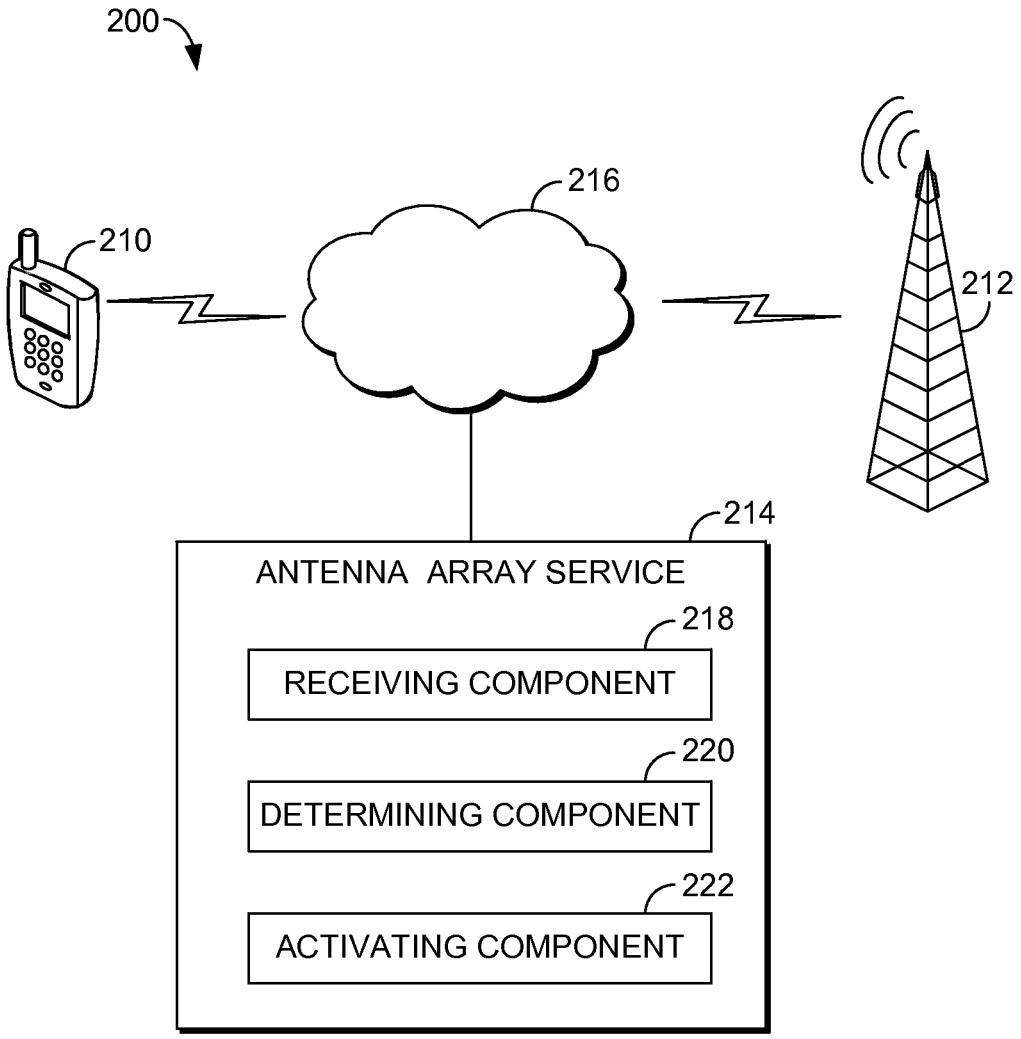
FIG. 2 depicts an illustrative operating system for adjusting an angular orientation of antenna array elements to optimize RF signal parameters at a mobile device according to an embodiment of the invention.

Turning now to FIG. 2, FIG. 2 depicts an exemplary network environment 200 suitable for use in implementing embodiments of the present invention. The network environment 200 is but one example of a suitable network environment and is not intended to suggest any limitation as to the scope of use or functionality of the invention. Neither should the network environment 200 be interpreted as having any dependency or requirement relating to any one or combinations of components illustrated.

In the network environment 200, one or more mobile devices 210 may communicate with other devices, such as mobile devices, servers, etc. The mobile device 210 may take on a variety of forms, such as a personal computer (PC), a laptop computer, a tablet, a notebook, a mobile phone, a Smart phone, a personal digital assistant (PDA), or any other device that is capable of wirelessly communicating with the other devices using the network 200. The mobile device 210 may comprise the mobile device 100 of FIG. 1, and as such can include, for example, a display(s), a power source(s) (e.g., a battery), a data store(s), a speaker(s), memory, a buffer(s), an antenna, and the like. In embodiments, the mobile device 210 comprises a wireless or mobile device with which a wireless-telecommunication-network(s) (e.g., the network environment 200) can be utilized for communication (e.g., voice and/or data communication). In this regard, the mobile device 210 can be any mobile computing device that communicates by way of, for example, a 3G or 4G network.

The mobile device 210 can utilize a network 216 to communicate with other computing devices (e.g., a mobile device(s), a server(s), a personal computer(s), etc.) and/or with a base station such as the base station 212. In embodiments, the network 216 is a telecommunications network(s), or a portion thereof. A telecommunications network might include an array of devices or components, some of which are not shown so as to not obscure more relevant aspects of the invention. Components such as terminals, links, and nodes (as well as other components) can provide connectivity in some embodiments. The network 216 can include multiple networks, as well as being a network of networks, but is shown in more simple form so as to not obscure other aspects of the present invention. The network 216 can be part of a telecommunications network that connects subscribers or users to their immediate service provider. In embodiments, the network 216 can be associated with a telecommunications provider that provides services to mobile devices, such as the mobile device 210. For example, the network 216 may provide voice and/or data services to mobile devices or corresponding users that are registered to utilize the services provided by a telecommunications provider. The network 216 can be any communication network providing voice and/or data service(s), such as, for example, a 1× circuit voice, a 3G network (e.g., CDMA, CDMA2000, WCDMA, GSM, UMTS), or a 4G network (WiMAX, LTE, HSDPA).

The network environment 200 may include a database (not shown). The database may be similar to the memory component 112 of FIG. 1 and can be any type of medium that is capable of storing information. The database can be any collection of records. In one embodiment, the database includes a set of embodied computer-executable instructions that, when executed, facilitate various aspects disclosed herein. These embodied instructions will variously be referred to as "instructions" or an "application" for short.

The network environment 200 also includes the base station 212 and an antenna array service 214. The base station 212 may, in an LTE network, be known as an eNodeB. The base station 212 may be associated with the network 216 and communicate with, for instance, the mobile device 210. The communication may involve receiving RF signals from the mobile device 210 using antenna array elements and transmitting RF signals to the user device 210 using the antenna array elements. The components of network environment 200 have been illustrated separately but may, in fact, be integrated into a single component. For instance, the antenna array service 214 may be a component of the base station 212.

The antenna array service 214 includes at least a receiving component 218, a determining component 220, and an activating component 222. The receiving component 218 is adapted to, among other things, receive a communication or RF signal, such as an uplink communication signal from a mobile device such as the mobile device 210. More specifically, the receiving component 218 may be configured to monitor and receive RF uplink signals from a plurality of mobile devices communicating with the base station 212. In aspects, the receiving component 218 may further be configured to aggregate the uplink signals received from the mobile devices to generate a composite RF uplink signal.

The determining component 220 of the antenna array service 214 is configured to analyze the RF signals including the composite RF uplink signal to determine a number of different RF signal parameters associated with the composite signal. Select RF signal parameters may provide direct or indirect information about the strength and/or quality of the downlink RF signal (the communication signal from the base station to the mobile device). In aspects, the RF signal parameters may further comprise an indication of the angle at which the different mobile device antennas are currently oriented. This, in turn, may provide information on which mobile devices are being used primarily for data and which mobile devices are being used primarily for voice calls. Exemplary RF signal parameters may include, for example, received signal strength indicator (RSSI), received channel power indicator (RCPI), reference signal received power (RSRP), reference signal receive quality (RSRQ), and the like.

In response to the determinations made by the determining component 220, the activating component 222 is configured to activate a new set of cross-polarized antenna array elements that has a different angular orientation as compared to the previously activated set of cross-polarized antenna array elements. As used throughout this disclosure, the term "activate" means to enable the antenna array elements to transmit and/or receive communication signals. In aspects, this may be done by activating a set of cross-polarized microstrip antenna array elements that has a different angular orientation as compared to the angular orientation of a previously activated set of cross-polarized microstrip antenna array elements.

Figure 3:
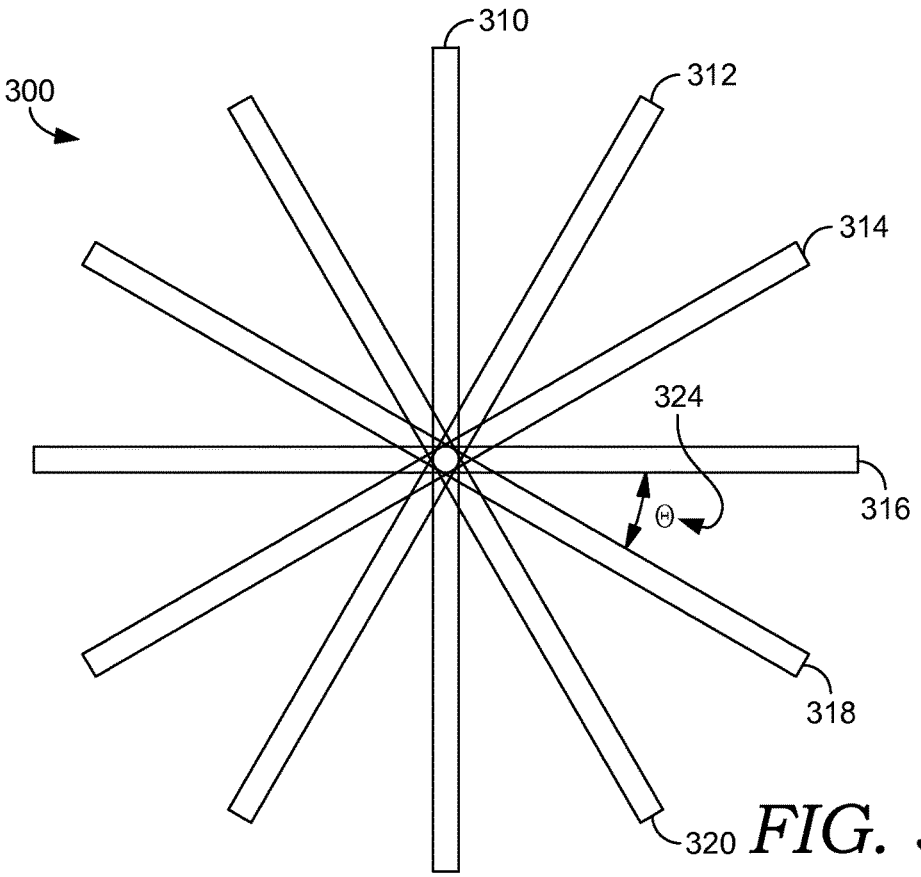
FIG. 3 depicts an exemplary configuration of antenna elements according to an embodiment of the technology.

FIG. 3 depicts an antenna 300 having a plurality of microstrip antenna elements in an exemplary configuration in accordance with aspects provided herein. The antenna 300 may be part of an antenna array associated with a base station such as the base station 212 of FIG. 2. The antenna 300 is comprised of three sets of orthogonally cross-polarized microstrips: Set 1 includes microstrips 310 and 316; Set 2 includes microstrips 312 and 318, and Set 3 includes microstrips 314 and 320. More specifically, Set 1 includes microstrip 312 oriented at 0 degrees and microstrip 316 oriented at +90 degrees. In other words, microstrip 316 is orthogonally cross-polarized to microstrip 310. This results in a low correlation between these two elements which helps to reduce interference between the elements. Similarly, Set 2 includes microstrip 312 oriented at +30 degrees and microstrip 318 oriented at +120 degrees, while Set 3 includes microstrip 314 oriented at +60 degrees and microstrip 310 oriented at +150 degress; the microstrips in both Set 2 and Set 3 are also orthogonally cross-polarized with respect to each other. Continuing, each microstrip element in the antenna 300 is oriented approximately 30 degrees from an adjacent microstrip element. For instance, microstrip 318 is angularly rotated 30 degrees relative to the microstrip 316.

The number, configuration, and angular rotation of microstrip elements in the antenna 300 is exemplary only and other configurations are contemplated herein. For example, there may be additional cross-polarized microstrip elements such that each microstrip element is angularly oriented approximately 15 degrees relative to an adjacent microstrip. In aspects, there may be fewer microstrip elements such that each microstrip element is angularly oriented approximately 60 degrees relative to an adjacent microstrip element. Any and all such angular orientations, such as, for example, angular orientations between +1 degree up to +60 degrees between adjacent microstrip elements are contemplated as being within the scope herein.

Figure 4:
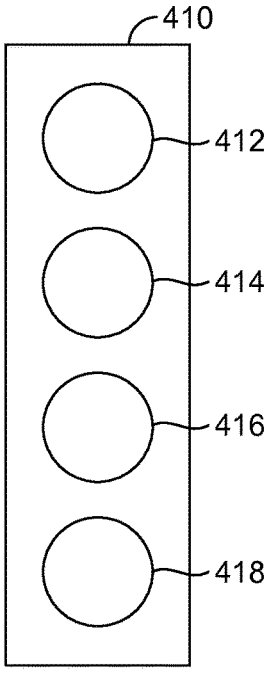
FIG. 4 depicts an illustrative antenna array according to an embodiment of the invention.

FIG. 4 illustrates how, for example, the antenna 300 may be part of an antenna array 410. For example, the antenna array 410 may comprise antenna 412, antenna 414, antenna 416, and antenna 418, all having a configuration similar to, for example, the antenna 300 or variants of the antenna 300 as explained above. The antennas 412, 414, 416, and 418 are shown as circles in FIG. 4 for illustrative purposes only. The illustration of the antenna array 410 is exemplary only and it is contemplated that more or less antennas may be part of the array 410.

Turning back to FIG. 2 and using FIGS. 3 and 4 for reference purposes, in response to the determinations made by the determining component 220, the activating component 222 activates to a new set of cross-polarized antenna array elements such that the new set of cross-polarized antenna array elements transmit and receive RF communication signals. When activating the new set of cross-polarized antenna array elements the orthogonal orientation between a given set of elements is maintained. The activating component 222 is further configured to deactivate the set of cross-polarized antenna array elements that was previously used to transmit and receive the communication signals.

By way of illustrative example and using FIG. 3 as a guide, Set 1 of the microstrip elements (e.g., microstrips 310 and 316) may be activated such that the microstrips 310 and 316 send and receive communication signals. However, it may be determined by the determining component 220 that RF signal strength and/or quality is not currently optimized at the mobile devices. In response to this determination, the activating component 222 may activate Set 2 of the microstrip elements (e.g., microstrips 312 and 318) and deactivate Set 1. Once activated, the microstrips 312 and 318 transmit and receive RF signals. RF uplink signals are received from the mobile devices and are analyzed by the determining component 220 to determine signal strength parameters and/or signal quality parameters. If the parameters are above, for instance, a predetermined minimum threshold indicating, for example, that the RF signal is optimized (i.e., is at nearly full strength and/or has good quality), the activating component 222 may not take any action. However, if the parameters are below the predetermined threshold, the activating component 222 may deactivate Set 2 and activate Set 3 of the microstrip elements (e.g., microstrips 314 and 320). This process iteratively repeats itself with the result that RF signal parameters are kept above the predetermined minimum threshold. This threshold may be configurable by the network 216.

Activation of the antenna elements takes place for each antenna in the array. With respect to FIG. 4, activation of, for instance, Set 1 of the microstrip elements by the activating component 222 takes place simultaneously for Set 1 of antenna 412, Set 1 of antenna 414, Set 1 of antenna 416, and Set 1 of antenna 418. The same holds true for activation of the different sets (e.g., Set 2 and/or Set 3).

Figure 5:
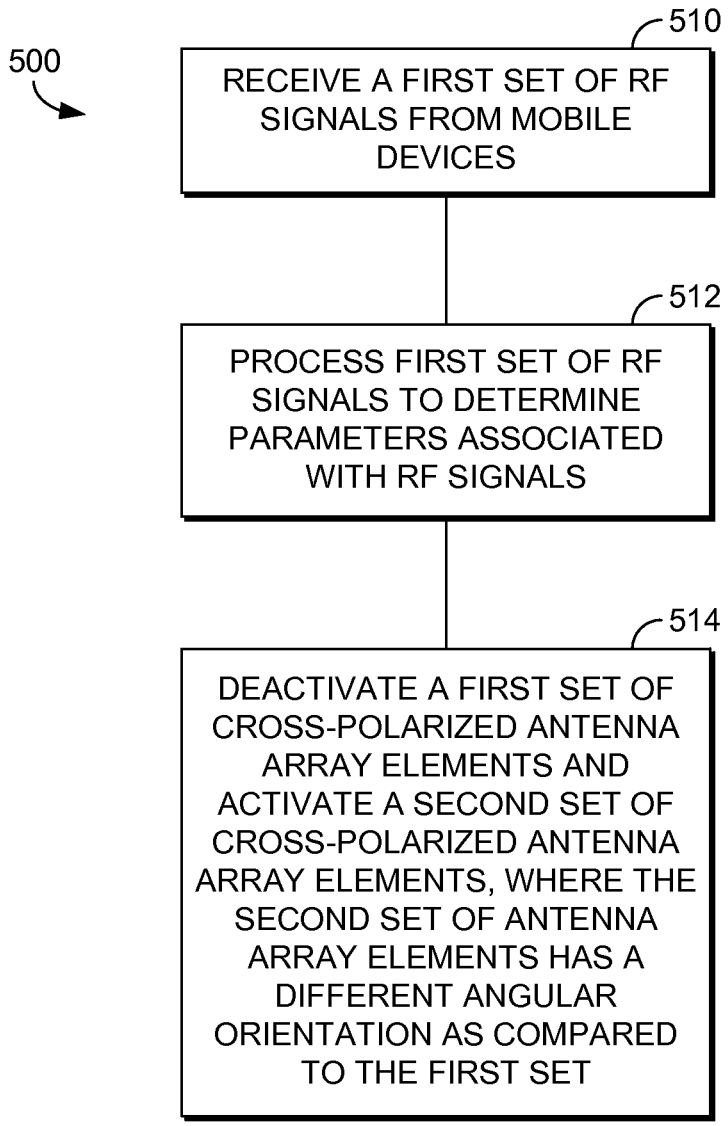
FIGS. 5-6 depict flow diagrams of exemplary methods of dynamically adjusting an angular orientation of cross-polarized antenna array elements to optimize select RF signal parameters associated with mobile devices according to embodiments of the technology.

Turning now to FIG. 5, a flow diagram is shown of an exemplary method 500 of dynamically adjusting an angular orientation of cross-polarized antenna array elements to optimize select RF signal parameters. The method 500 may be carried out by an antenna array service such as the antenna array service 214 of FIG. 2. Moreover, the antenna array service 214 may be part of a base station such as the base station 212 of FIG. 2.

At a step 510, a receiving component such as the receiving component 218 of FIG. 2 receives a first set of RF uplink signals from a plurality of mobile devices such as, for example, the mobile device 210 of FIG. 2. At a step 512, the RF uplink signals are processed by a determining component such as the determining component 220 of FIG. 2 to determine RF signal parameters. RF signal parameters may provide an indication of signal strength and/or quality at the mobile devices and may include such things as RSSIs, RCPIs, RSRPs, RSRQs, and the like. RF signal parameters may further comprise indicators of how the mobile device antenna is currently oriented.

At a step 514, an activating component, such as the activating component 222 of FIG. 2, deactivates a first set of cross-polarized antenna array elements and activates a second set of cross-polarized antenna array elements, where the second set has a different angular orientation relative to the first set. In aspects, the first and second sets of antenna array elements may comprise microstrip elements as depicted in FIG. 3. For example, the second set may be angularly oriented approximately +15, +30, or +60 degrees relative to the first set. Any and all such aspects, and any variation thereof, are contemplated as being within the scope herein.

The deactivation/activation step may occur after it is determined that the RF signal parameters are below a predetermined threshold that is set, for instance, by the telecommunication provider. Once activated, the second set of antenna array elements is able to transmit and receive communication signals.

The method 500 may continue with the receiving component receiving a second set of RF uplink signals from the mobile devices. The determining component processes the second set of RF signals to determine the RF signal parameters discussed above. The determining component may further determine whether the parameters are above or below the predetermined minimum threshold. When the parameters are below the threshold, the activating component deactivates the second set of cross-polarized antenna array elements and activates a third set of cross-polarized antenna array elements that has a different angular orientation relative to the second set of antenna array elements. In aspects, the third set may be the same as the first set of antenna array elements. In other words, the third set of antenna array elements may have the same angular orientation as the first set of antenna array elements. In another aspect, the third set of antenna array elements may have an angular orientation that is different from both the first and second sets of antenna array elements. Any and all such aspects, and any variation thereof, are contemplated as being within the scope herein. The third set of antenna array elements may also comprise microstrip elements.

Figure 6:
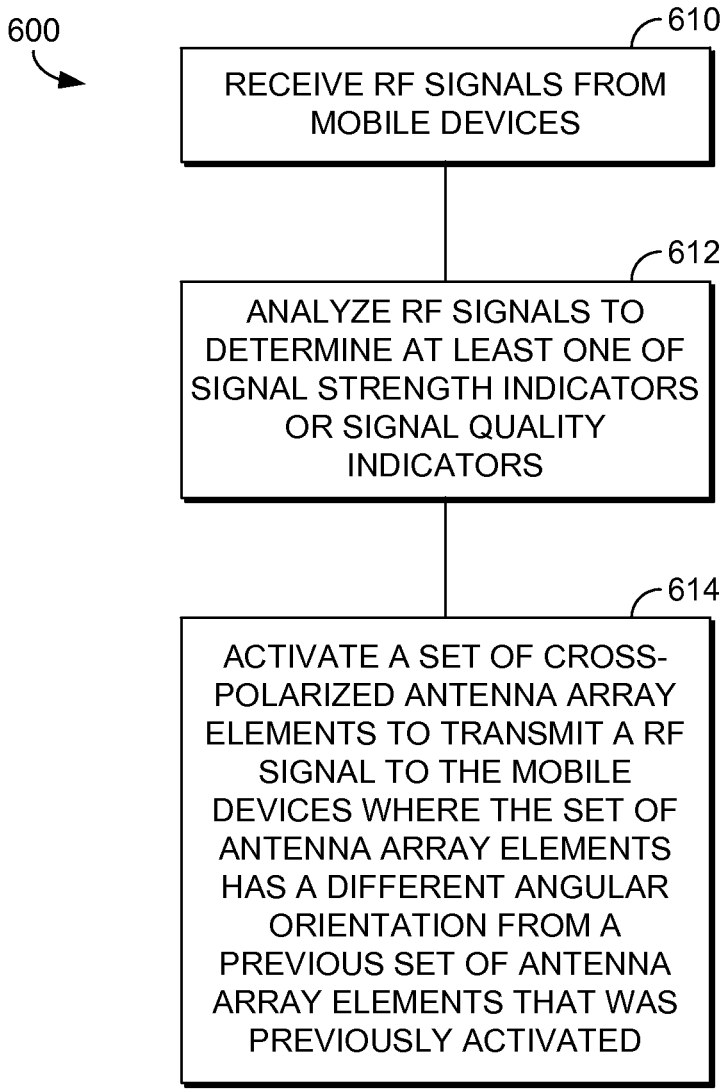

FIG. 6 depicts a flow diagram of an exemplary method 600 of dynamically adjusting an angular orientation of cross-polarized antenna array elements to optimize select RF signal parameters. At a step 610, RF uplink signals from a plurality of mobile devices are received by a receiving component, such as the receiving component 218 of FIG. 2. In aspects, the receiving component may aggregate the RF signals to generate a composite RF signal.

At a step 612, the RF signals (or the composite RF signal) are analyzed by a determining component, such as the determining component 220 of FIG. 2, to determine one or more parameters associated with the signals. The parameters may indicate, for example, signal strength at the mobile devices, signal quality at the mobile devices, orientation of mobile device antennas, and the like. In an exemplary aspect, only a portion of the RF signals are analyzed to determine the parameters. The portion analyzed may correspond to subscribers or users who have upgraded service plans that may guarantee, for instance, certain download speeds and/or other quality parameters. In aspects, the determining component may further determine whether the parameters meet one or more predetermined thresholds.

At a step 614, an activating component, such as the activating component 222 of FIG. 2, activates a new set of cross-polarized antenna array elements that has a different angular orientation relative to a different set of cross-polarized antenna array elements that was previously activated. Once activated, the new set of antenna array elements is able to transmit and receive communication signals. The method 600 may further comprise deactivating the set of antenna array elements that was previously activated such that the set is no longer able to transmit or receive communication signals. Similar to the method 500, the angular orientation of the new set of antenna array elements may be between +15, +30, or +60 degrees relative to the set of antenna array elements previously activated.

When only a portion of the RF signals from subscribers having upgraded service plans is analyzed, activation of the new set of antenna array elements preferentially targets these subscribers resulting in, for example, faster data transfer speeds, and the like.

Many different arrangements of the various components depicted, as well as components not shown, are possible without departing from the scope of the claims below. Embodiments of our technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

What is claimed is:

1. One or more non-transitory computer-readable media having computer executable instructions embodied thereon that, when executed, perform a method of dynamically adjusting an angular orientation of antenna array elements to optimize select radio-frequency (RF) signal parameters associated with a plurality of mobile devices, the method comprising:

at a base station:

receiving at the base station a first set of RF signals from the plurality of mobile devices;

processing the first set of RF signals to determine one or more parameters associated with the first set of RF signals;

based on the processed first set of RF signals, determining a first subset of mobile devices of the plurality of mobile devices that have one or more of a signal strength and a signal quality below a predetermined threshold;

determining a second subset of mobile devices of the plurality of mobile devices that have one or more of a signal strength or a signal quality above the predetermined threshold;

determining that the first subset of mobile devices is greater than the second subset of mobile devices; and based on determining that the first subset of mobile devices is greater than the second subset of mobile devices, deactivating a first set of cross-polarized antenna array elements and activating a second set of cross-polarized antenna elements, the second set of antenna array elements having a different angular orientation relative to the first set of antenna array elements.

2. The media of claim 1, wherein the first set of antenna array elements and the second set of antenna array elements comprise microstrip antenna elements.

3. The media of claim 1, wherein the second set of antenna array elements is angularly oriented at least 30 degrees relative to the first set of antenna array elements.

4. The media of claim 1, wherein the second set of antenna array elements is angularly oriented at least 60 degrees relative to the first set of antenna array elements.

5. The media of claim 1, further comprising:

receiving a second set of RF signals from the plurality of mobile devices;

processing the second set of RF signals to determine the one or more parameters associated with the second set of RF signals;

based on the processed second set of RF signals, determining a third subset of mobile devices of the plurality of mobile devices that have one or more of a signal strength and a signal quality below the predetermined threshold;

determining that the third subset of mobile devices is greater than the first subset of mobile devices; and based on determining that the third subset of mobile devices is greater than the first subset of mobile devices, deactivating the second set of antenna array elements and activating a third set of cross-polarized antenna array elements.

6. The media of claim 5, wherein the third set of antenna array elements has a different angular orientation as compared to the second set of antenna array elements, and wherein the third set of antenna array elements has a different angular orientation as compared to the first set of antenna array elements.

7. The media of claim 5, wherein the third set of antenna array elements has the same angular orientation as the first set of antenna array elements.

8. The media of claim 5, wherein the third set of antenna array elements comprises microstrip antenna elements.

9. A computerized method carried out by at least one server having one or more processors for performing a method of dynamically adjusting an angular orientation of cross-polarized antenna array elements to optimize select radio-frequency (RF) signal parameters, the method comprising:

at a base station:

receiving at the base station a plurality of RF signals from a plurality of mobile devices;

analyzing, using the one or more processors, the plurality of RF signals to determine one or more parameters associated with the received signals, the one or more parameters comprising at least one of signal strength indicators or signal quality indicators;

based on the analyzed plurality of RF signals, determining a first subset of mobile devices of the plurality of mobile devices that have one or more of the signal strength indicators and the signal quality indicators below a predetermined threshold;

determining a second subset of mobile devices of the plurality of mobile devices that have one or more of the signal strength indicators and the signal quality indicators above the predetermined threshold;

determining that the first subset of mobile devices is greater than the second subset of mobile devices; and based on determining that the first subset of mobile devices is greater than the second subset of mobile devices, activating a set of cross-polarized antenna array elements so as to transmit a RF signal to the plurality of mobile devices, the set of antenna array elements having a different angular orientation from a previous set of cross-polarized antenna array elements that was previously activated.

10. The method of claim 9, further comprising transmitting the RF signal to the plurality of mobile devices using the set of antenna array elements.

11. The method of claim 9, wherein the one or more parameters further comprise an indication of antenna orientation angles associated with the plurality of mobile devices.

12. The method of claim 9, wherein the set of antenna array elements has an angular orientation that is 15 degrees or less relative to the previous set of antenna array elements.

13. The method of claim 9, wherein the set of antenna array elements has an angular orientation between 15 degrees and 30 degrees relative to the previous set of antenna array elements.

14. A system for dynamically adjusting an angular orientation of cross-polarized antenna array elements to optimize select radio-frequency (RF) signal parameters, the system comprising:

a computing device having one or more processors and one or more computer-readable media having computer-executable instructions embodied thereon that, when executed by the one or more processors, perform operations comprising:

activating a first set of cross-polarized antenna array elements associated with a base station, the first set of antenna array elements having a first angular orientation;

receiving RF signals from a plurality of mobile devices;

analyzing the RF signals received from at least a portion of the plurality of mobile devices to determine one or more RF parameters associated with the received signals;

based on the analyzed RF signals, determining a first subset of mobile devices of the plurality of mobile devices that have one or more of a signal strength and a signal quality below a predetermined threshold;

determining a second subset of mobile devices of the plurality of mobile devices that have one or more of a signal strength or a signal quality above the predetermined threshold;

determining that the first subset of mobile devices is greater than the second subset of mobile devices; and based on determining that the first subset of mobile devices is greater than the second subset of mobile devices, activating a second set of cross-polarized antenna array elements associated with the base station, the second set of antenna array elements having a second angular orientation different from the first angular orientation.

15. The system of claim 14, further comprising deactivating the first set of antenna array elements.

16. The system of claim 14, wherein activating the second set of antenna array elements comprises enabling the transmission and receipt of RF signals.

17. The system of claim 14, wherein the at least the portion of the plurality of mobile devices is associated with users having upgraded service plans with a wireless-telecommunications-provider.

18. The system of claim 14, wherein the second set of antenna array elements has an angular orientation between 15 degrees to 30 degrees relative to the first set of antenna array elements.

* * * * *